US005612065A

United States Patent [19]

Keller

[11] Patent Number: 5,612,065

[45] Date of Patent: Mar. 18, 1997

[54] APPARATUS FOR PRODUCING MOLDINGS FROM, IN PARTICULAR, CONCRETE

[75] Inventor: Gottfried Keller, Allmendingen, Germany

[73] Assignee: Rampf Formen GmbH, Allmendingen, Germany

[21] Appl. No.: 396,233

[22] Filed: Mar. 1, 1995

[30] Foreign Application Priority Data

Mar. 4, 1994 [DE] Germany ..... 44 07 127.2

[51] Int. Cl.[6] ..... B28B 11/10

[52] U.S. Cl. ..... 425/356; 425/457; 425/468; 425/469

[58] Field of Search ..... 425/356, 457, 425/468, 469; 249/176, 177

[56] References Cited

U.S. PATENT DOCUMENTS

| | | | |
|---|---|---|---|
| 786,261 | 4/1905 | Brichta | 425/356 |
| 839,125 | 12/1906 | Dyer | 425/468 |
| 981,929 | 1/1911 | Kramer | 425/469 |
| 3,115,678 | 12/1963 | Keen et al. | 425/386 |
| 3,284,858 | 11/1966 | Taccone | 425/DIG. 19 |
| 3,534,450 | 10/1970 | Ipsen | 425/457 |
| 3,642,419 | 2/1972 | Toksvig | 249/177 |
| 3,764,244 | 10/1973 | Hurley et al. | 425/78 |

FOREIGN PATENT DOCUMENTS

| | | |
|---|---|---|
| 0118872 | 9/1984 | European Pat. Off. . |
| 927283 | 10/1947 | France . |
| 2074867 | 10/1971 | France . |
| 139820 | 1/1902 | Germany . |
| 8714786 U | 2/1988 | Germany . |
| 7709763 | 3/1979 | Netherlands . |
| 120735 | 7/1919 | United Kingdom . |
| 210689 | 2/1924 | United Kingdom . |

*Primary Examiner*—Thomas R. Weber
*Attorney, Agent, or Firm*—Spencer & Frank

[57] ABSTRACT

An arrangement for producing a molded concrete article which has a surface including zones at varying levels. The arrangement includes three groups of punches defining respective impression depths into the concrete article, and a molding device including three head plates, each of which is connected to a corresponding one of the groups of punches. An upper head plate is connected to a group of punches having a deepest impression depth. A lower head plate disposed below the upper head plate is connected to a group of punches having a shallowest impression depth. An intermediate head plate is connected to a group of punches which has an impression depth between the deepest impression depth and the shallowest impression depth, wherein the groups of punches are connected in a descending order of their impression depths to their corresponding head plates disposed successively below the upper head plate, and wherein any one group of punches connected to a head plate disposed above at least one other head plate passes through the at least one other head plate. Two guide rods suspend head plates below the upper head plate, each guide rod having a stop at a lower end thereof adapted to determine a lowest position of the corresponding one of the head plates. A load is applied to the head plates through the upper head plate.

11 Claims, 5 Drawing Sheets

31
33
37
35
30
12'
32
34
36

APPARATUS FOR PRODUCING MOLDINGS FROM, IN PARTICULAR, CONCRETE

FIELD OF THE INVENTION

The invention relates to an apparatus for producing moldings from, in particular, concrete, the upper side of the moldings exhibiting zones which are at different levels. The apparatus has a punch arrangement which is fitted into a molding box and comprises a plurality of punches which are arranged such that they can move relative to one another in the vertical direction.

BACKGROUND OF THE INVENTION

An apparatus of the above type is known from European Patent Specification 0 118 872. This patent specification is concerned with the production of a molding which exhibits a lower-lying annular surface ruling along the border. The punch arrangement thus comprises two part-punches, one punch being guided on the other punch, and a stop, which limits the movement of one part-punch towards the bottom, being arranged on the other part-punch. In the case of a known two-part punch arrangement according to German Utility Model 87 14 786 too, one part-punch is guided on the other part-punch and has its movement clearance limited by stops.

The above type of punch arrangment is not, however, suitable for moldings with a multiplicity of adjacent impressions at different levels. Rather, the known designs are matched closely to the molding to be produced in each case, this resulting in non-commercially viable manufacturing and, in the event of a change in the molding to be produced, retiring re-designing again and again.

SUMMARY OF THE INVENTION

The object of the invention is to propose a molding apparatus with a punch arrangement which permits simple adaptation to moldings, the surface area thereof being divided up in any manner, and which can be produced cost-effectively.

Taking as a departure point, an apparatus of the type mentioned in the introduction, this object is achieved according to the invention as an arrangement which includes three groups of punches defining respective impression depths into the concrete article, and a molding device including three head plates, each of which is connected to a corresponding one of the groups of punches. An upper head plate is connected to a group of punches having a deepest impression depth. A lower head plate disposed below the upper head plate is connected to a group of punches having a shallowest impression depth. An intermediate head plate is connected to a group of punches which has an impression depth between the deepest impression depth and the shallowest impression depth, wherein the groups of punches are connected in a descending order of their impression depths to their corresponding head plates disposed successively below the upper head plate, and wherein any one group of punches connected to a head plate disposed above at least one other head plate passes through at least one other head plate. Two guide rods suspend head plates below the upper head plate, each guide rod having a stop at a lower end thereof adapted to determine a lowest position of the corresponding one of the head plates. A load is applied to the head plates through the upper head plate. In accordance therewith, the punch arrangement, first of all, may exhibit three or more punch groups, depending on the number of molding surface zones at different levels. Each of the punch groups is fastened on a separate head plate, the head plates ideally being of the same size and being arranged parallel to one another. In this arrangement, the punches of the head plate which is arranged at a respectively higher level pass through the head plates located therebeneath, e.g. in the case of three punch groups, the punches fastened on the uppermost head plate pass through the two other head plates and the punches of the central plate pass through the lowermost plate. In order to guide the head plates in a vertical direction, the lower head plates are assigned guide rods which pass through the head plate which is assigned to them and at least the head plate which is arranged thereabove, and exhibit stops which limit the spacings between the head plates. The stops are designed expediently as heads or as cross-pieces which are screwed on the lower end surfaces of the guide rods.

By virtue of using cross-sectionally round guide rods which may have a degree of play in the guide bores of the head plates which amounts to 1 mm, problem-free manufacturing and assembly are possible.

In a further development of the invention, there are proposed punches which each comprise a pressure-exerting piece and one or more cross-sectionally likewise round pressure-exerting rods, the latter being fastened on the appertaining head plate. The pressure-exerting rods expediently have, at both ends, threaded shafts of a smaller diameter, by means of which, on the one hand, they are screwed into the pressure-exerting piece and, on the other hand, are plugged through the head plate and fastened by a nut. Apart from the different lengths, the pressure-exerting rods are all the same. They are fastened on the pressure-exerting piece at the center of gravity of the surface thereof. In the case of relatively large pressure-exerting pieces, a plurality of pressure-exerting rods may be used. Since all the pressure-exerting rods are fastened on head plates, it suffices to provide the fastening bores thereof, at their correct location in each case, it being possible for this to be carried out very cost-effectively and with a high degree of accuracy, in particular, with computer-assisted manufacturing machines.

Since the pressure-exerting rods should expressly not be used for guiding the lower-lying head plates, they pass through said head plates with play. It is, however, proposed that the pressure-exerting pieces are at such a level, with respect to the movement of the adjacent pressure-exerting pieces, that, in every position, they can touch with their side surfaces and guide one another.

The arrangement of the punches is preferably such that the punches which are fastened on the uppermost head plate and receive the advancement and vibratory forces directly from the punch ram penetrate into the molding material to the greatest extent. Thus, the head plates adjoining towards the bottom, each bear shorter punches which penetrate to a lesser extent from plate to plate. However, in order for these punches, which are fastened on the lower head plates, to also reach their end position during the molding operation and to also be sufficiently vibrated, there are fastened, on the lower head plates, spacer strips which, in the end position of the molding operation, come to bear on the head plate which is respectively located thereabove, and thereby transmit the forces to the best possible extent. A plurality of intersecting spacer strips are preferably provided, which are arranged such that the forces are transmitted uniformly onto the plates located therebeneath and the punches which are arranged thereon.

Cleaning of the pressure-exerting pieces, wherever possible after each molding operation, is extremely important for the quality of the moldings. Cleaning is, however, difficult to carry out if the end surfaces of the pressure-exerting pieces are not located at a suitable level. For the above reason, the stops on the guide rods are expediently set such that, in the demolding position, when the lower head plates bear on the stops, the lower end surfaces of all the punches are located approximately in one horizontal plane. If a brush roll is then allowed to move through beneath the punches, then the bristles can clean off all the remaining molding material adhering to the punches.

Difficulties may arise when working with the molding apparatus described if, as a result of the configuration of the molding, the pressure-exerting pieces of one punch group have to penetrate particularly deeply into the molding material in comparison with the rest. Penetration is made more difficult because the adjacent molding material cannot rise up without obstruction, but is held back by the rest of the pressure-exerting pieces and is already pre-compacted. A possibility for overcoming this difficulty consists in the fact that at least the lower head plate is supported with respect to the machine framework with the aid of spring arrangements, with the result that, in the event of a molding operation, the head plate passes into its lower end position only after the rest of the head plates have come to bear thereon, exerting their bearing force thereon. The spring arrangements should at least have enough power for them to be able to bear the weight of the head plate and the punches thereof.

This results in the pressure-exerting pieces which are connected to the lowermost head plate coming to rest on the molding material only at an advanced state of the molding operation, that is to say at a point in time at which the more deeply penetrating pressure-exerting pieces have already passed virtually into their end position. When, for example in the case of three pressure-exerting plates altogether, the uppermost pressure-exerting plate has come to bear on the central pressure-exerting plate and the latter, in turn, has come to bear on the lowermost pressure-exerting plate, the spring arrangements are compressed, until finally all the pressure-exerting plates are located one upon the other and all the punches have reached their end positions. In the event of demolding, finally, the punches of the lower head plates first of all stay back when the uppermost head plate is raised. By virtue of the weight of the second head plate and the punch thereof, the spring arrangements initially remain compressed. When the second head plate is then raised, via the corresponding stops, then the third head plate follows immediately, and is raised under the action of the spring arrangements.

However, the above-described joint movement of the last punch groups can result in additional shortcomings during demolding. The aim should thus be that, during the molding operation, all of the punches, from the start, assume the relative position with respect to one another which, due to the desired configuration of the molding, they must also assume at the end of the molding operation.

The above is achieved, in accordance with a further proposal, in that the head plates are penetrated by tie rods which exhibit a stop at the lower end and, at the top, are fastened on a carrying plate, and that bellows which can be actuated by compressed air are provided in order to raise the carrying plate with respect to the uppermost head plate, with the result that all the head plates can be drawn together until they bear one against the other. This relative position of the pressure-exerting pieces too is brought about by a corresponding compressed-air control arrangement at the beginning of the lowering movement. Upon reaching the end position, air is rapidly extracted from the bellows, with the result that the individual punch groups are then raised from the molding in order.

It has already been mentioned that the pressure-exerting pieces, which are suspended with their lower ends approximately in one plane after the demolding displacement, can be cleaned by means of a brush roll. In this arrangement, it has occasionally turned out to be a particular advantage of the compressed-air control means that the cleaning operation may, if desired, also be carried out in an intermediate position, in the case of which, for example, the higher and more soiled pressure-exerting pieces project downwards to a small extent. This can be achieved, for example, by a slow filling of the bellows via a throttle valve.

BRIEF DESCRIPTION OF THE DRAWINGS

The invention is described below with reference to drawings of preferred exemplary embodiments, where.

DETAILED DESCRIPTION OF THE INVENTION

The drawings depict in each case a molding apparatus for producing so-called soundproofing panels as are used, for example, in soundproofing walls for fast roads.

Figure 1:
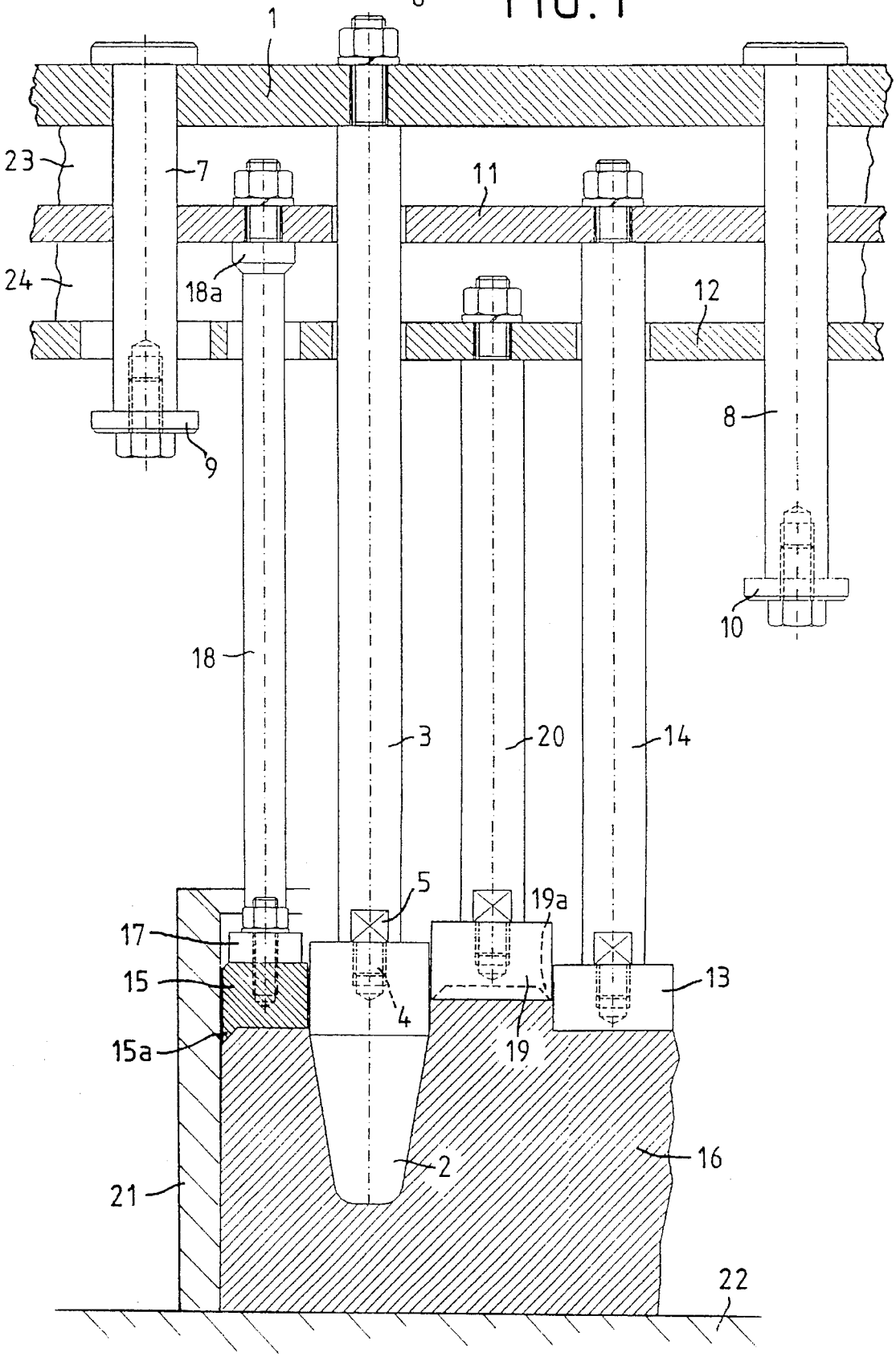
FIG. 1 shows a vertical partial section of a first molding apparatus according to the invention at the end stage of the molding operation.
Figure 2:
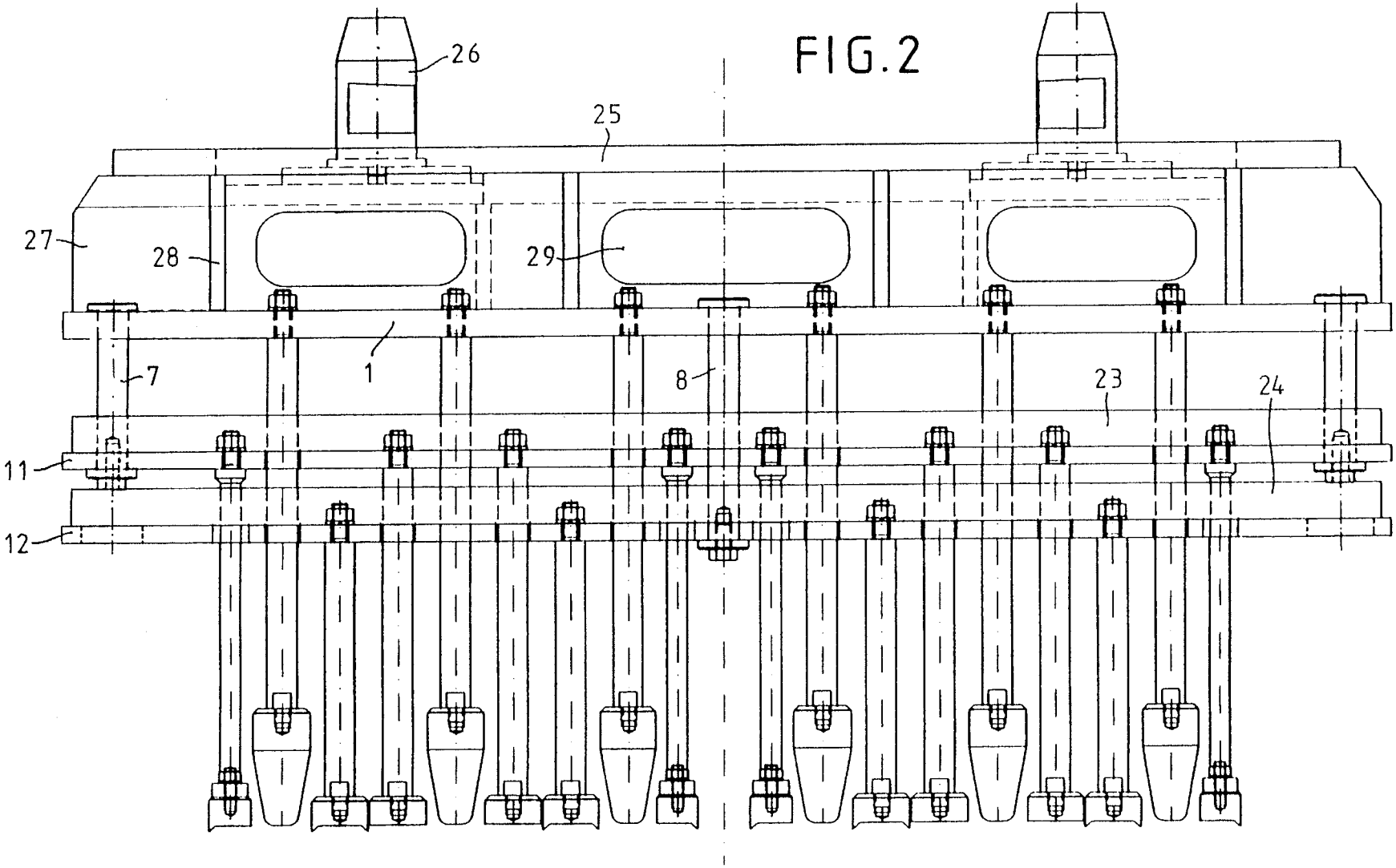
FIG. 2 shows a view of the complete punch arrangement according to FIG. 1.

For reasons of clarity, all the forms of the punch are moved into one plane in FIGS. 1 and 2. Therefore, the bore pattern according to FIG. 3 does not exactly correspond to FIGS. 1 and 2.

FIG. 1 shows a portion of an upper head plate 1 on which a deeply penetrating, large pressure-exerting piece 2 is fastened by means of a pressure-exerting rod 3. The upper part of the pressure-exerting piece 2 is approximately in the form of a cube, and adjoining this towards the bottom is a four-faced wedge, the lower end surface having slightly rounded-off edges. The pressure-exerting rod 3 has, just as the others, a round cross-section and an integral threaded shaft at both ends. The lower, somewhat shorter threaded shaft 4 is screwed into a blind hole of the pressure-exerting piece 2 and is secured by means of an adhesive. In order, in this arrangement, to be able to retain the pressure-exerting rod, faces 5 are milled on two opposite sides. The upper threaded shaft 6 is plugged through a bore in the head plate I and fastened by means of a nut, precise angular alignment being possible.

The head plate 1 according to FIG. 1, furthermore, bears two downwardly projecting guide rods 7 and 8 of different lengths. The guide rods are inserted, up to their flat heads, in locating bores of the head plate 1, and stop disks 9 and 10 are screwed onto their lower end surfaces. The guide rods 7 and 8 serve for guiding a central head plate 11 and a lower head plate 12. The bores thereof have a degree of play of approximately 1 mm with respect to the guide rods. While in each case only one guide rod is shown in FIG. 1, provision is actually made, at suitable locations, for as many guide rods as are necessary, in practice, for this purpose.

The central head plate 11 bears a pressure-exerting piece 13 which is of a square outline and has a smooth underside. The pressure-exerting piece 13 is fastened, in the above-described manner, on the head plate 11 by means of a somewhat shorter pressure-exerting rod 14. Furthermore, there is positioned, on the central head plate 11, a pressure frame 15 which shapes the peripheral border strip of the surface of the sound-proofing panel 16 to be manufactured. The pressure frame 15 comprises individual rectilinear parts which are conneared to one another by screwed-on connecting strips 17. The pressure frame has, on the underside, a peripheral triangular rib 15*a* which shapes the border bevel of the soundproofing panel 16. The pressure frame 15 is suspended on the head plate 11 via a plurality of pressure-exerting rods 18 which are of a smaller diameter than the rest, for which reason a collar 18*a* is integrally formed at the upper end of each pressure-exerting rod, such that use can be made of the same thread as for the rest of the pressure-exerting rods. Finally, a pressure-exerting piece 19 is fastened on the head plate 12 via a pressure-exerting rod 20, said pressure-exerting piece 19 having the same outline as the pressure-exerting piece 13, but exhibiting, on its underside, a triangular rib 19*a* which runs around all four borders and forms a bevel on the molding. The pressure-exerting piece 19 penetrates to the least extent into the molding composition and thus forms those parts of the molded soundproofing panel 16 which project upwards to the greatest extent, the edges of which are thus protected.

You are expressly referred to the fact that the through-passage openings in the head plates 11 and 12 for the pressure-exerting rods 3, 14, 20 permit play of 2.5 mm around the rods. The head plates 11 and 12 thus do not guide the punches. Rather, the pressure-exerting pieces 2, 13, 15 and 19 are guided, during their vertical movement, by bearing directly one against the other.

Also indicated in FIG. 1 is a side wall of the molding box 21 as well as a vibrating table 22.

Figure 3:
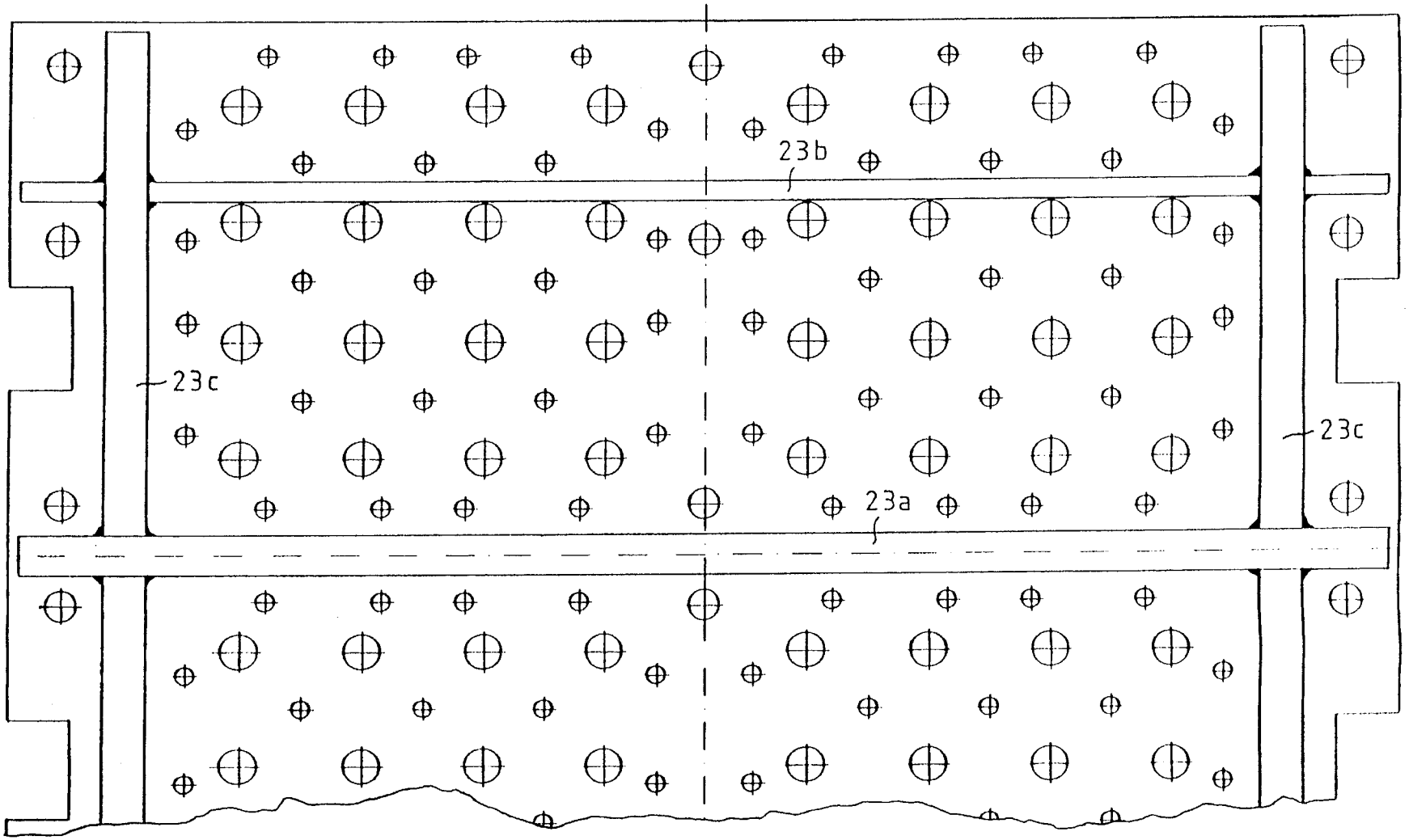
FIG. 3 shows a partial plan view of one of the head plates as used in punch arrangements according to the invention.

The relative position of the punches with respect to one another which is represented is obtained by virtue of spacer strips 23 and 24 which are each fitted on the head plates 11 and 12. In FIG. 3, for example, the arrangement of the strips 23 is represented in plan view. In order to distribute the downwardly pressing forces on the head plates as uniformly as possible, provision is made for a central longitudinal strip 23*a*, two parallel longitudinal strips 23*b* on both sides, and two transverse strips 23*c*. These are all at the same level. In the position shown in FIG. 1, the spacer strip 23 bears on the head plate 1, and the spacer strip 24 bears on the head plate 11.

If the punch arrangement shown in FIG. 1 is drawn upwards for demolding, then only the pressure-exerting pieces 2, fastened on the upper head plate 1, move initially. When, finally, this movement has progressed to such an extent that the stop disk 9 of the guide rod 7 comes to bear on the head plate 11, the head plate 11 is also carried along, and thus also the pressure frame 15 and various pressure-exerting pieces 13. In this arrangement, account should be taken of the fact that the opening in the lower head plate 12, which is penetrated by the guide rod 7 according to FIG. 1, has a diameter large enough for the stop disk 9 also to pass through it with a large amount of play. After further movement, the stop disks 10, finally, carry the head plate 12 along with them, with the result that the pressure-exerting piece 19 is then also raised from the molding, and thus all the pressure-exerting pieces and the pressure frame 15 are in the raised state.

The above position is shown in FIG. 2. The essential factor here is that the lower end surfaces of the pressure-exerting pieces are essentially all located in one horizontal plane and can thus be satisfactorily cleaned, for example, by means of a brush roll fitted on the filling carriage of the molding machine.

It can be seen in FIGS. 2 and 3 that, by means of the punch arrangement given in the above example, four soundproofing panels can be molded with one displacement. Four pressure frames 15 are provided. The molding box is correspondingly configured with two central walls arranged in the form of a cross.

It can finally be seen from FIG. 2 that the head plate i is carefully reinforced by a complex rib structure. This structure, also called load, comprises a load plate 25 into which two king pins 26 are inserted. The upwardly projecting pins with milled-out cross-slots are received by a quick-action clamping device which draws the load plate 25 into close contact with the ram plate of the molding machine. Reinforcing ribs 27 and 28, which run in the form of a cross and, in order to cut down on weight, are provided in certain areas with window cutouts 29, connect the load plate 25 to the head plate 1.

Figures 4, 5:
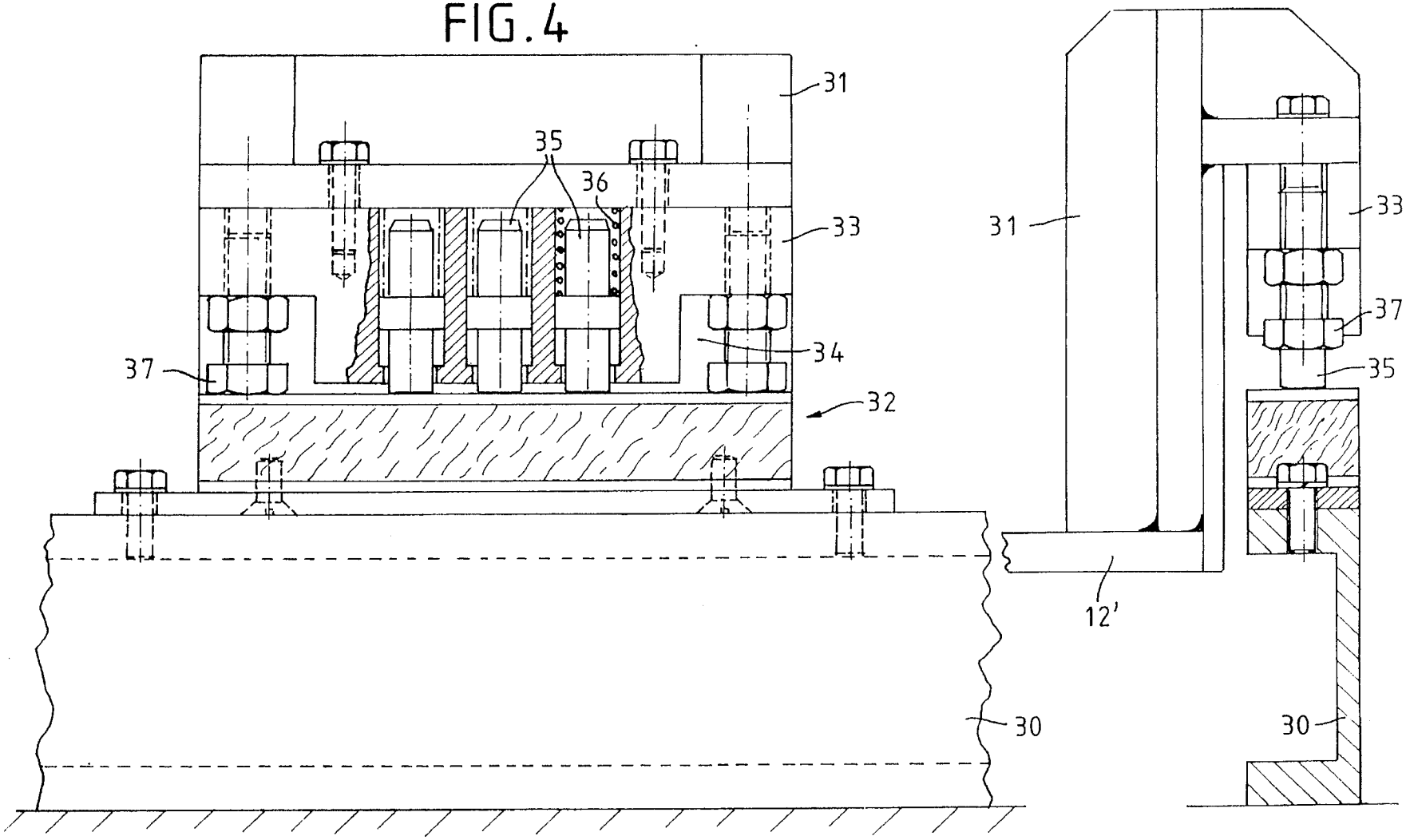
FIG. 4 shows a side view of a spring arrangement, partially in section, for the lowermost head plate, in another molding apparatus according to the invention.
FIG. 5 shows an end view of the arrangement according to FIG. 4.

FIGS. 4 and 5 show a spring and stop arrangement of a further molding apparatus, of which the lower head plate 12' of likewise three head plates is represented only in FIG. 5. The head plate is 12' is, ith this arrangement, supported with respect to a frame profile 30 of the relevant machine frame. An angled-off bracket 31 which projects beyond the frame profile 30 is welded on the head plate 12'. Fastened on the frame profile 30, at this location, is a rubber-metal vibration damper 32. A spring housing 33 is screwed beneath the bracket 31. The housing has a central, higher part and is reduced in height on both sides (FIG. 4) by lower cutouts 34. The central part has three vertical bores in which three push rods 35 are mounted such that they can be displaced longitudinally. They are pushed downwards by in each case one helical spring 36, the helical springs being supported, at the top, on the bracket 31 and, at the bottom, on a central collar of the push rods 35. In order that the push rods 35 are not pushed out, the bores each have, at the bottom, a shoulder against which the collar of the respective push rod butts. Inserted into the end parts of the spring housing 33 is in each case one stop screw 37, which can be adjusted by means of a lock nut.

In the relieved position according to FIG. 5, the push rods 35 are pushed out of the housing 33, with the result that the head plate 12' assumes a higher position than in FIG. 4, and the stop screws 37 are free at the bottom. When, however, during the molding operation, the upper head plate presses on the lower head plate 12' via the central head plate, then the spring arrangement yields, the push rods are displaced into the spring housing 33 and, finally, the stop screws 37 also come to bear on the rubber-metal vibration damper 32. This is, then, the end position, shown in FIG. 4, of the head plate 12' after the molding operation.

Figure 6:
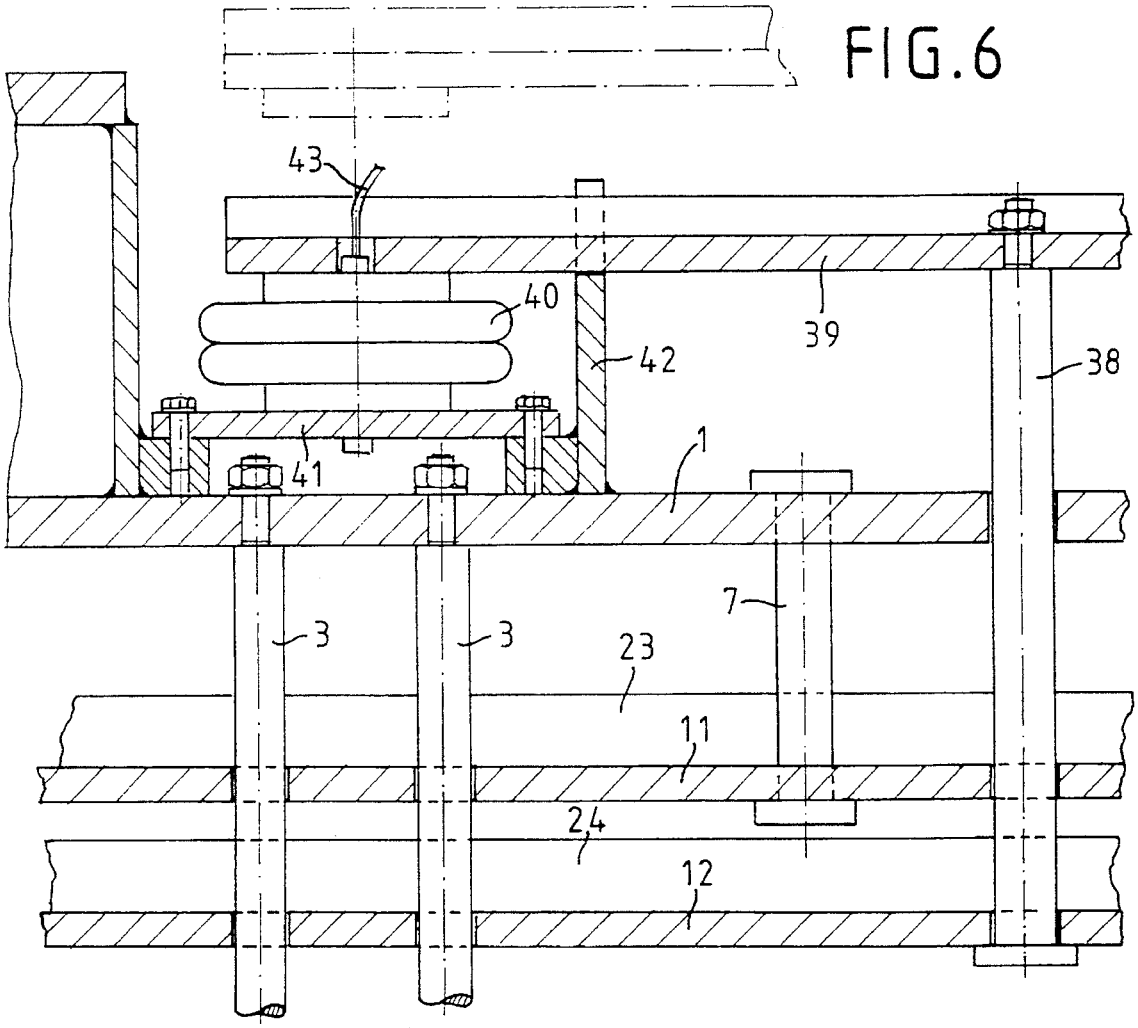
FIG. 6 shows a partial view of a yet another molding apparatus according to the invention having a bellows which can be activated by compressed air and is intended for drawing together the three head plates.
Figure 7:
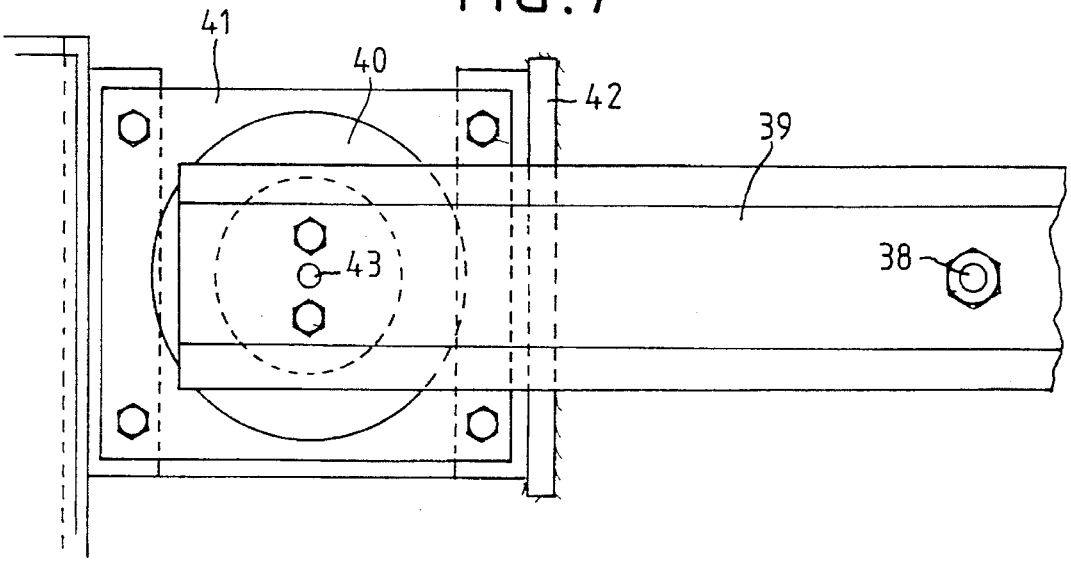
FIG. 7 shows a plan view of the arrangement according to FIG. 6.

Of the molding apparatus according to FIGS. 6 and 7, all three head plates 1, 11 and 12 are represented in FIG. 6. Two pressure-exerting rods 3, which run downwards from the upper head Plate I and are intended for the large pressure-exerting pieces 2, are indicated. The central head plate 11 is suspended, in this demolding position, on the head plate i by means of the guide rods 7. In contrast to the example according to FIG. 1, however, a guide rod 8, which defines the maximum spacing between the head plate I and the head plate 12, is not provided. Instead, however, provision is made for a longer tie rod 38 which also passes through the head plate 1 and, at the top, is fastened on a carrying plate 39. The carrying plate 39, which is elongated in the manner of a rail in accordance with FIG. 7, is, at the end which is shown and at the other end which is not shown, supported, via a bellows 40, on a plate 41 which is screwed on the head plate 1. For supporting at a defined level when the bellows 40 is in the relieved state, an upright flat profile 42 is welded onto the head plate 1.

The bellows 40 may be activated by compressed air via a supply line 43. In this arrangement, the bellows expand to such an extent that the carrying plate 39 is raised to the upper position indicated by chain-dotted lines. In this arrangement, the tie rod 38 then draws up the lower head plate 12 until its spacer strip 24 butts against the central head plate 11, and then draws up the two head plates until the upper spacer strip 23 butts against the head plate 1. The punches are thus in the relative position shown in FIG. 1, the position, in this case, having been forced already at the beginning of the downward displacement and being maintained until the end of the molding operation. The pressure-exerting pieces 2 can consequently penetrate more easily into the molding material and/or the displaced molding material can yield to a better extent. When the end position is reached, air is rapidly extracted from the bellows 40, with the result that the demolding operation takes place precisely as in the case of the molding apparatus according to FIG. 1, i.e. the respective punch groups of the head plates 1, 11 and 12 are drawn upwards in order. Advantageously, activation of the bellows 40 by compressed air can be changed during the manufacturing operation for the purpose of adjustment and optimization.

I claim:

1. An arrangement for producing a molded concrete article which has a surface including zones at varying levels, the arrangement comprising:

a molding surface;

a molding box that is open on a top thereof and receiving the concrete article therein, the molding box resting on the molding surface; and a molding device including:

at least three groups of punches disposed above the molding box and completely covering the surface of the concrete article, each group of punches further being configured to produce impressions on the concrete article at a depth different from a depth of impressions produced by another group of punches, the groups of punches thereby defining respective impression depths into the concrete article;

at least three head plates, each head plate being connected to a corresponding one of the groups of punches, the head plates including:

an upper head plate connected to a group of punches of the groups of punches which has a deepest impression depth with respect to the other groups of punches, the upper head plate being adapted to transmit a load to the other head plates;

a lower head plate disposed below the upper head plate and connected to a group of punches of the groups of punches which has a shallowest impression depth with respect to the other groups of punches; and at least one intermediate head plate disposed between the upper head plate and the lower head plate and connected to a group of punches of the groups of punches which has an impression depth between the deepest impression depth and the shallowest impression depth, wherein the groups of punches are connected in a descending order of their impression depths to their corresponding head plates disposed successively below the upper head plate, and wherein any one group of punches connected to a head plate disposed above at least one other head plate passes through the at least one other head plate; and at least two guide rods for suspending head plates below the upper head plate, each guide rod having a stop at a lower end thereof adapted to determine a lowest position of the corresponding one of the head plates, wherein a guide rod passes through its corresponding head plate and through at least a head plate disposed thereabove.

2. The arrangement according to claim 1, wherein the stops on the guide rods are one of head and cross-pieces screwed onto end surfaces of the guide rods.

3. The arrangement according to claim 1, wherein each group of punches includes:

a plurality of pressure-exerting pieces; and a plurality of substantially cylindrical pressure-exerting rod connecting respective ones of the pressure-exerting pieces to a head plate corresponding to the group of punches.

4. The arrangement according to claim 3, wherein adjacent pressure-exerting pieces from respective groups of punches have touching side surfaces which guide the pressure-exerting pieces in their displacement.

5. The arrangement according to claim 1, wherein the molding device further includes spacer strips fastened to head plates disposed successively below the upper head plate for transmitting compressive and vibratory forces from the upper head plate onto the head plates disposed successively therebelow.

6. The arrangement according to claim 1, wherein, in a free suspension of the groups of punches, lower end surfaces of the punches are located approximately in one horizontal plate.

7. The arrangement according to claim 3, wherein the pressure-exerting rods include threaded shafts at both ends thereof having a smaller diameter than a diameter of the rods.

8. The arrangement according to claim 1, wherein the molding device includes spring arrangements operatively connected to the lower head plate for bearing, with respect to a machine framework for the molding device, at least a weight of the lower head plate and the groups of punches corresponding thereto, whereby, in a molding operation, the lower head plate assumes its lowest position only after head plates disposed thereabove exert their downward force on the spring arrangements.

9. The arrangement according to claim 1, wherein:

the head plates define tie rod openings therein; and the molding device includes:

a carrying plate disposed above the upper head plate;

a plurality of tie rods passing through tie rod openings of the head plates, the tie rods having respective stops at lower ends thereof and being connected to the carrying plate at upper ends thereof; and bellows disposed below the carrying plate and adjacent thereto, the bellows being adapted to be actuated by compressed air for raising the carrying plate with respect to the upper head plate, whereby a raising of the carrying plate draws all of the head plates together until the head plates rest against one another.

10. The arrangement according to claim 9, wherein the molding device further includes a compressed-air control means operatively connected to the bellows for pressurizing the bellows in a molding operation and for depressurizing the bellows in a de-molding operation.

11. The arrangement according to claim 10, wherein the control means is adapted to admit air into the bellows for a cleaning operation of the punches, the arrangement further including brushes disposed on a filling carriage located adjacent the molding device for cleaning the punches.

* * * * *